United States Patent [19]

Austin et al.

[11] 3,988,216

[45] Oct. 26, 1976

[54] METHOD OF PRODUCING METAL STRIP HAVING A GALVANIZED COATING ON ONE SIDE WHILE PREVENTING THE FORMATION OF A ZINC DEPOSIT ON CATHODE MEANS

[75] Inventors: Lowell W. Austin; Edwin J. Smith; Leslie D. McGraw, all of Weirton, W. Va.

[73] Assignee: National Steel Corporation, Pittsburgh, Pa.

[22] Filed: Oct. 15, 1975

[21] Appl. No.: 622,624

[52] U.S. Cl. ..... 204/28; 204/206; 204/211; 204/268; 204/DIG. 7

[51] Int. Cl.[2] ..... C25D 3/22; C25D 7/06; C25D 5/02

[58] Field of Search ..... 204/15, 28, 206, 208, 204/211, 268, 254, 146, DIG. 7, 228

[56] References Cited

UNITED STATES PATENTS

| | | | |
|---|---|---|---|
| 1,798,391 | 3/1937 | Wurth | 204/DIG. 7 |
| 2,655,473 | 10/1953 | Lowenheim | 204/268 |
| 2,673,836 | 3/1954 | Vonada | 204/28 |
| 3,178,305 | 4/1965 | Ward | 204/146 |
| 3,429,787 | 2/1969 | Weinreich | 204/268 |
| 3,901,771 | 8/1975 | Froman | 204/268 |

*Primary Examiner*—T. M. Tufariello
*Attorney, Agent, or Firm*—Shanley, O'Neil and Baker

[57] ABSTRACT

A method for producing galvanized metal sheet or strip material having a zinc coating on one side only. The method includes immersing a strip (zinc-coated on both sides) in an electrolyte and passing it between anode means and separate cathode means so as to remove a zinc coating from one side of the strip while simultaneously depositing a substantially equivalent amount of zinc on the opposite side of the strip. The cathode means is immersed in a separate caustic catholyte solution which is kept separate from the main electrolyte by an anion exchange membrane, supported at least partly within the electrolyte, so as to prevent migration of zinc ions from the main electrolyte to the catholyte and cathode means and the formation of a deposit on the cathode means. The method is most economically performed with a steel strip having a differential coating of zinc.

32 Claims, 3 Drawing Figures

METHOD OF PRODUCING METAL STRIP HAVING A GALVANIZED COATING ON ONE SIDE WHILE PREVENTING THE FORMATION OF A ZINC DEPOSIT ON CATHODE MEANS

BACKGROUND OF THE INVENTION

This invention relates to a method for producing galvanized metal sheet or strip material having a zinc coating on one side only. More particularly, this invention relates to a method for treating zinc-coated metal strip or sheet material so as to remove the zinc coating from one side thereof while simultaneously depositing a substantially equivalent amount of zinc on the opposite side and at the same time preventing the formation of a zinc deposit on cathode means utilized in the process.

The use of galvanized metal sheet or strip material is conventional in many applications where corrosion resistance is important. However, in some cases, particularly when used in automobile body construction and the like, it is undesirable to have a zinc coating on both sides of the metal sheet or strip since such a coating has an undesirable effect on the weldability and surface finishing of the metal. In such instances it is important to provide a material having a galvanized surface on one side of the metal sheet, which side is generally unprotected otherwise, and a clean surface on the opposite side for efficient weldability and cosmetically acceptable surface finishing, such as painting.

The electrolytic methods proposed in the past for the production of such one side-galvanized material have all been characterized by the formation of a zinc deposit on cathode means. In the usual cases such deposits must be removed and various methods are employed for this purpose including reversing the polarity of the system, dissolving the deposits in acid, or by peeling. Whichever procedure is selected, this added operation in the process decreases its efficiency.

SUMMARY OF THE INVENTION

It has now been discovered that metal sheet or strip material having a zinc coating on one side may be electrolytically produced without a concurrent deposition of zinc on cathode means utilized in the process, by an electrolytic treatment which includes passing the material through an electrolyte solution and between anode means and separate cathode means so that the coating on the metal sheet or strip material opposite the cathode means is removed from the metal base and an amount of zinc equal to that removed is simultaneously deposited on the opposite side of the material. The cathode means is immersed in a separate, caustic catholyte solution which is isolated from the main electrolyte by a perm-selective anion exchange membrane. In such an arrangement, the sheet or strip material functions as a "bipolar" electrode, and the zinc ions in the main electrolyte are prevented by the membrane from migrating to the vicinity of the cathode means. This method is particularly applicable in treating differentially zinc-coated material wherein the thickness of the zinc coating on one side is less than the thickness of the zinc coating on the opposite side. In treating such material the strip will be passed through the electrolyte so that the side having the relatively thinner, i.e., lighter, coating faces the cathode means and the opposite side faces the anode means.

DETAILED DESCRIPTION OF THE INVENTION

According to this invention, zinc-coated metal strip or sheet material is electrolytically treated to produce a galvanized product having a zinc coating on one side only, the other side being uncoated for maximum weldability and surface finishing. As used hereinafter the term "strip"should be construed as including sheet material. An essential feature of the invention is the isolation of cathode means from the main electrolyte solution so as to prevent the formation of a zinc deposit thereon. The isolation of the cathode means is accomplished through the use of a perm-selective anion exchange membrane which separates the main electrolyte from a catholyte solution in which the cathode means is immersed.

In its broadest sense this invention comprises immersing a zinc-coated metal strip (coated on both sides) in an electrolyte solution so that it passes between anode means immersed in the main electrolyte and cathode means immersed in a catholyte solution which is separated from the main electrolyte by a perm-selective membrane. In such an arrangement the metal strip functions as a bipolar electrode, the result of which is the removal of the zinc coating from the side of the metal strip adjacent the cathode means while a substantially equivalent amount of zinc is simultaneously plated onto the opposite side of the strip, i.e., that adjacent the anode means. Since the cathode means is isolated by the anion membrane from the zinc ions in the electrolyte it is impossible for a zinc deposit to form thereon. It is also important to note that the only substance depleted in this process is water which decomposes at the cathode means to yield hydrogen gas and hydroxyl ions and at the anode means to yield oxygen gas and hydrogen ions. The hydroxyl ions formed at the cathode means carry the current through the anion membrane and into the electrolyte where they unite with the hydrogen ions generated at the anode means to reform water.

Figure 1:
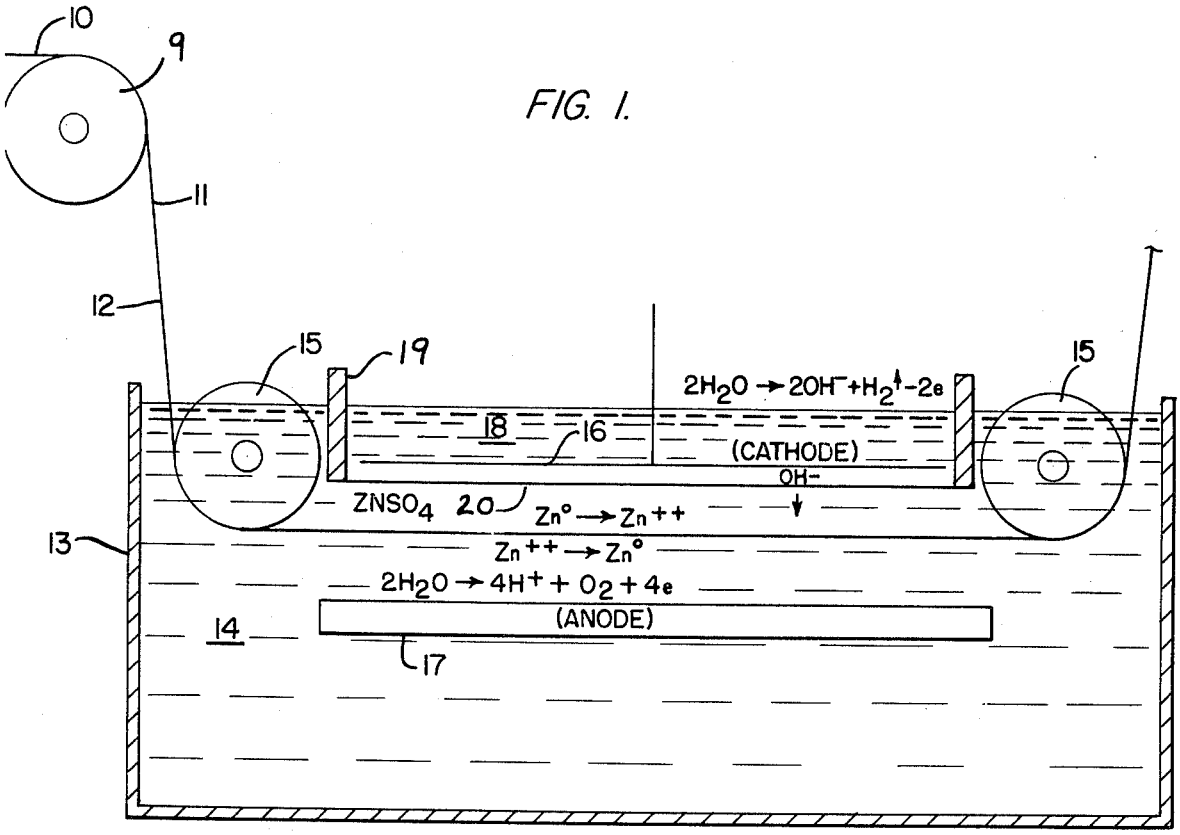
FIG. 1 is a schematic of one method for coating wherein the anode and cathodes are arranged in a horizontal configuration.

These reactions are illustrated in detail in FIG. 1 of the drawings. Referring specifically to FIG. 1, a steel strip 10 is supplied from a coil or other means not shown. The strip is differentially coated with zinc so that the thickness of the coating on one side 11 is less than the coating on the opposite side 12. It is guided by suitable deflector rolls, one of which is shown at 9, so that it passes into a tank 13 filled with a dilute aqueous solution, shown generally at 14, of sulfuric acid and zinc sulfate, and under sink rolls 15. The strip passes through the electrolytic solution between a cathode 16 and anode 17 which are connected respectively to direct current connections not shown. It is important that the side 11 of the strip, which is the side from which the zinc coating is removed, is facing the cathode as it passes through the electrolyte. The cathode 16 is immersed in a 5 percent by weight aqueous sodium hydroxide solution, shown generally at 18, which is separated from the electrolyte 14 by a container structure including wall portions 19, a foraminous bottom portion 20, and a perm-selective anion membrane which is sealed in any convenient manner to the wall portions 19 and supported by the formainous bottom portion 20. Usually the membrane will be bonded to its supporting structure by any convenient means. After a period of use the membrane may become spent whereupon it will be removed and replaced with a new membrane.

As the strip passes between the anode and the isolated cathode, the zinc coating on the side of the strip 11 adjacent the cathode is oxidized to zinc ions which go into solution, while a substantially equivalent amount of zinc ions are reduced to zinc metal and deposits on the side of the strip facing the anode. Water dissociates at the anode and cathode as indicated, the hydroxyl ions which are generated at the cathode functioning to carry the current through the membrane into the electrolyte. The membrane, of course, prevents zinc ions from migrating to the cathode. Thus, zinc is simultaneously removed from and plated on respective sides of the steel strip without the formation of zinc on the cathode. It has been noted that the conventional hot-dipped zinc coating on steel comprises three layers; a top zinc layer, an intermediate iron-zinc alloy layer, and a metallics layer, presumed to be an iron-zinc-aluminum alloy, which contacts the substrate. At higher current densities, i.e., usually greater than 500 amps/ft$^2$, usually all of these layers will be removed from the deplated side of the strip. However, at lower current densities, i.e., usually lower than 500 amps/ft$^2$, a black metallics layer may remain as a loose coating after the deplating treatment. In that event, as the strip emerges from the treatment apparatus the deplated side thereof may be subjected to a light brushing to remove the residual loose coating. The brush selected for this purpose should be one that will not cause scarring on the surface of the strip. A brush sold by Minnesota Mining & manufacturing Co. under the mark Scotchbrite has been found to be useful in this regard.

Figure 2:
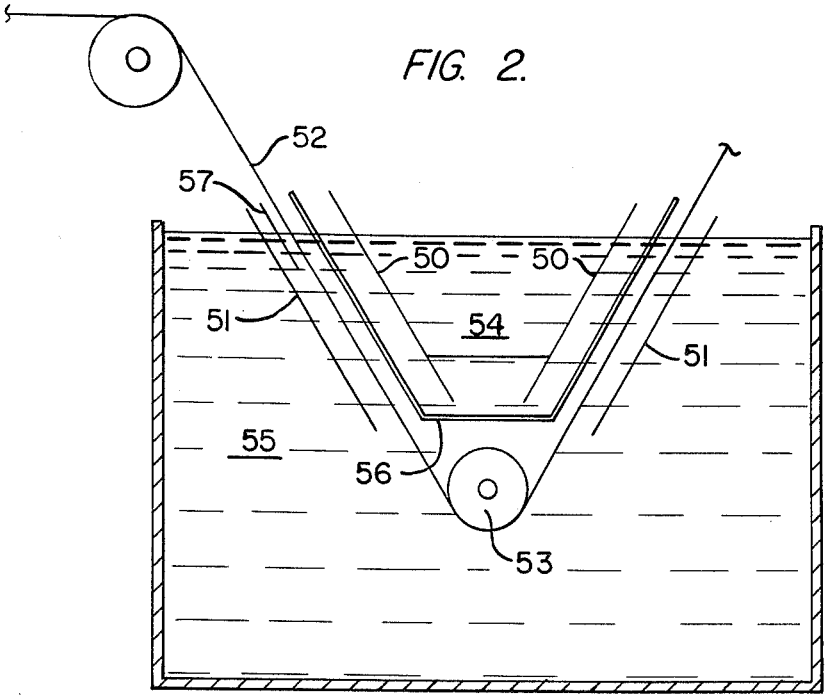
FIG. 2 is a schematic of a different embodiment wherein the cathodes and anode are arranged in a diagonal configuration.

The apparatus schematically illustrated in FIG. 2 operates essentially the same as that depicted in FIG. 1 except that the cathodes 50 and anodes 51 are arranged in a diagonal configuration, the strip 52 being supplied from a coil or other suitable source, not shown, and passed between the electrodes by deflector rolls 53. As in the embodiment of FIG. 1, the cathodes are immersed in a catholyte, shown generally as 54, which is separated from the electrolyte, shown generally as 55, by a perm-selective anion membrane 56. A shield 57 of inert material, such as polypropylene or polyvinyl chloride, supported in any convenient manner, is positioned so that it initially insulates or masks the side of the strip having the heavier zinc coating from the anode to promote etching of that coating thus faciliting a greater adhesion thereto of the subsequently plated zinc layer. The arrangement of FIG. 2 will in some cases be preferred since it facilitates removal of gas formed at the electrodes and provides a treatment substantially equivalent to that of the horizontal design but in a much smaller floor space.

Of course, it is possible to place at least two of the electrolytic cells described above in series and this will permit a speeding up of the line or the utilization of a lower current density.

The metal strip to be treated, preferably a steel strip 6 to 72 inches wide, may be hot-dipped or coated in any desired manner but in any event it is coated on both sides with a zinc coating. In order to limit the time and current required to remove the zinc coating from one side of the strip it is preferred to have a differentially coated strip, i.e., having the lowest coating weight commercially possible on one side. This differential coating may be accomplished by any conventional method but the most convenient and preferred method is that disclosed in U.S. Pat. No. 3,499,418. Such a product will generally have a zinc coating on one side which is about 0.1 ounce/ft$^2$, generally 0.01 – 0.15 ounce/ft$^2$ and a thicker, i.e., heavier, coating on the opposite side, generally 0.2 – 0.7 ounce/ft$^2$. Of course, where desired strip material having a very light zinc coating on both sides can be produced by the apparatus of U.S. Pat. No. 3,499,418. The strip material may be provided in its commercially acceptable coil form or it may be introduced into the system adapted to carry out the present invention directly from a conventional metal coating line including, for example, a pre-treatment section consisting of cleaning and/or pickling plus rinsing, a deposition or coating section, and a post-treatment section.

The electrolyte in which the strip is immersed (identified herein as the "main electrolyte") is formed of a relatively low acidic solution consisting essentially of divalent ions of zinc, generally having a pH within the range of 1.0 – 4.0, but preferably less than 2 for reasons which will be described hereinafter. In the preferred case, the electrolyte comprises an aqueous solution of zinc sulfate and sulfate acid and may contain conventional additives such as minor amounts of aluminum sulfate, magnesium sulfate and sodium sulfate; the latter compounds providing improved conductivity and a "whiter" deposit. Usually, zinc sulfate will be added in an amount which provides between about 10 – 20 ounces of zinc metal per gallon of electrolyte at a pH range of from about 1.0 – 4.0. Usually the electrolyte will be maintained at a temperature within the range of about 120° F to 150° F with a preferred temperature being 135° F. As previously indicated, the electrolyte is isolated from the cathode means by a container structure including a perm-selective anion membrane which holds a caustic catholyte solution in which the cathode means is immersed.

The catholyte may be any suitable caustic solution but it is important that it contain no metallic ions which can be deposited on the cathode. Preferred catholytes included aqueous sodium hydroxide and potassium hydroxide solutions, the alkali content being within the range 5 – 15 percent by weight. It should be emphasized, however, that a low concentration of hydroxide is desirable and a 5 percent aqueous solution has been found to be very satisfactory.

The anion exchange membrane separating the electrolyte from the catholyte includes an anion exchanger held onto a foraminous support by a binder. It contains a fixed positive charge and a mobile negative charge, the fixed positive charge functioning to repel positively charged ions. Thus, the anion membrane repels positively charged zinc ions and prevents them from getting through to the cathode while allowing negatively charged hydroxyl ions to pass through its structure. The membrane acts as a sieve and is perm-selective. An equilibrium is eventially set up so far as migration of negative ions are concerned. Any of the conventional anion exchange membranes may be utilized in this invention, their selection being determined by desired temperature and chemical stability. Included among the anion exchange membranes which have been found to be useful are those manufactured by Ionac Chemical Company and sold under their mark Ionac MA 3475 and Ionac 3475 R. Each of these membranes contain strong base type anion exchange resins. They are generally supplied in dry form but they may be prepared for use according to a method described in a bulletin entitled "Ionac Ion Exchange Membranes" which is publicly distributed by Ionac Chemical Company. The membranes utilized in this invention will generally have a thickness of from 7 to 15 mils but in any event should be thick enough to prevent tearing during their use. The above mentioned Ionac membranes have been shown to have a chemical stability up to 125° C and problem free operation utilizing a current density as high as 1,000 amps/ft$^2$. In some cases, usually during use of high current densities, a precipitate of zinc hydroxide will form on the side of the membrane facing the anode, a problem which can be cured either by increasing the acid content of the electrolyte to a pH of 2 or less, for example down to about 1.0, or by a preferred method which includes introducing air agitation around the membrane by any conventional means, such as tubing, so as to eliminate local areas of higher pH near the membrane and move the hydroxyl ions into a low pH area where they may be neutralized by hydrogen ions to form water before they can react with the zinc ions.

The maintenance of a low pH, i.e., less than 2 in the electrolyte around the anode is also useful in treating hot-dipped zinc-coated metal strip where it is sometimes difficult to obtain a strong bond between the zinc surface and the plated layer. This problem will be eliminated by maintaining a low current density near the surface of the electrolyte where the strip is entering the solution so that in the low pH environment a slight etching of the spangled surface will occur thus promoting greater adhesion between the base zinc layer and the electroplated layer. The most convenient manner for maintaining such a low current density near the surface of the electrolyte is to employ a shield or masking element as depicted in FIG. 2. Of course other means may be utilized to achieve this slight etching but the acidic low current density treatment is preferred since it simply requires initial strip contact with the acid electrolyte prior to its passage between the anode and cathode. However, it is important to note in this regard that the acid concentration of the electrolyte should not be so high as to adversely affect the smooth surface of the deplated side of the strip, which for use in the automotive industry should have a finished smoothness of 40 – 50 microinches as measured on a Bendix Profilometer.

When immersed in the electrolyte solution the strip will pass between a cathode means and anode means so that there is a spacing of about 0.5 to 3 inches, preferably 1 – 2 inches, between the strip and the anode and a spacing of about 1 – 4 inches, preferably about 2 inches, between the strip and the cathode.

Figure 3:
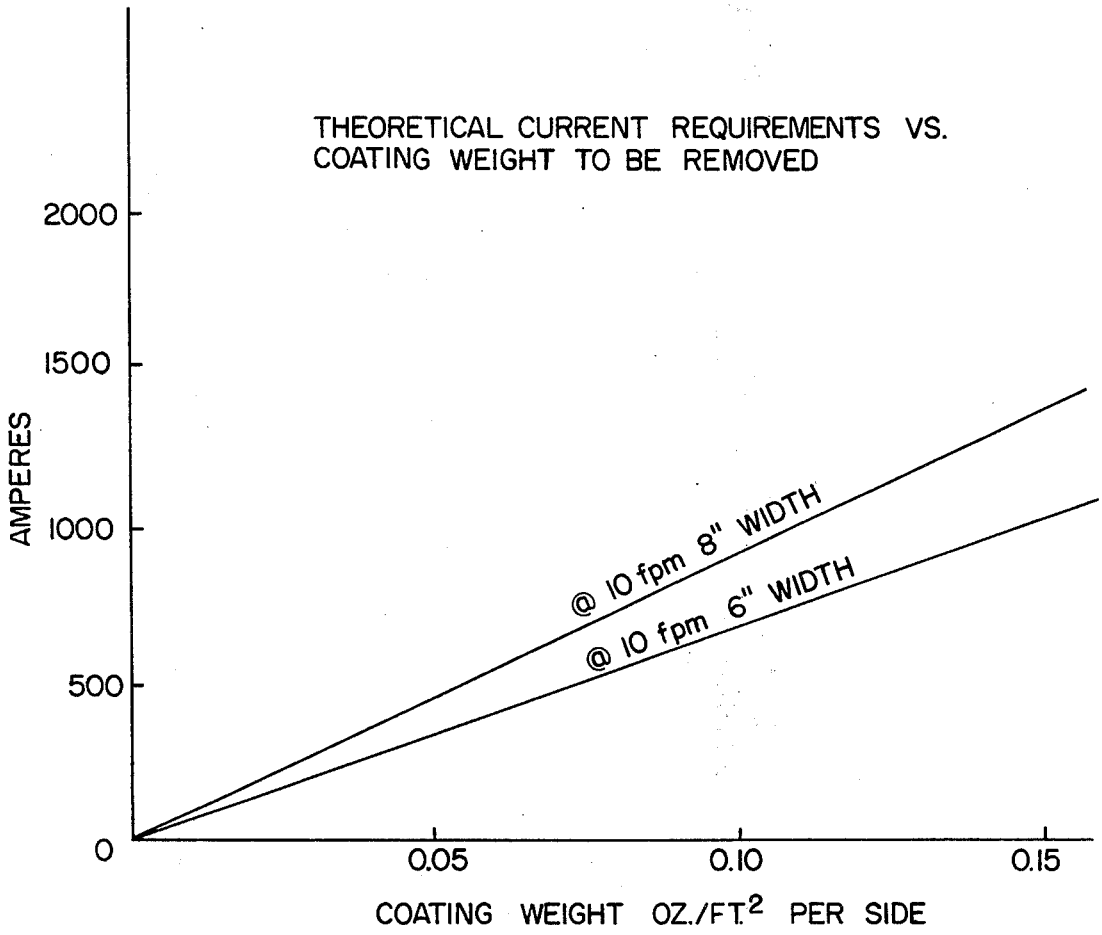
FIG. 3 is a graph depicting the relation of theoretical current requirements versus coating weight to be removed.

For maximum effectiveness, current densities on the strip, i.e., the bipolar electrode, within the "shadow" of the external electrodes, i.e., cathode and anode, should be between about 200 to 1,000 amps/ft$^2$. A current density of about 500 amps/ft$^2$ is preferred. Of course the current density selected will be determined in part by the thickness or weight of the zinc coating to be removed. The theoretical current requirements may be conveniently determined by reference to FIG. 3 of the drawings or by calculation using the following formula:

$$\text{amperes} = \frac{\text{ft}^2}{\text{seconds}} \times (\text{mgs/ft}^2) \times \frac{\text{coul.}}{\text{mgs}}$$

The strip is preferably passed between the electrodes at a line speed of from 100 to 400 feet per minute. The electrolyte is generally circulated within the tank, preferably directed towards the strip so as to minimize turbulance within the tank. In some instances it will become necessary to increase voltage in order to offset a polarization type effect presumably caused by a lack of movement in the ions emanating from the strip being treated. Under such circumstances there is a need for a greater circulation to redistribute the ions in solution and this increase in circulation may be accomplished by any conventional means. Also, if there is insufficient circulation in the electrolyte, burned areas form on the strip initially at the edges since the current densities are higher there.

It may be necessary to cool the catholyte (using any conventional means, such as a steel cooling coil) since there is resistive heating in the catholyte which may raise the temperature to a point where it will adversely affect the useful life of the anion membrane. In general, the temperature of the catholyte and electrolyte should be maintained at about the same point, plus or minus 10°.

The cathode means utilized in the invention is preferably a good conductor and is of a material which does not react with the caustic catholyte solution. Included among those materials found to be useful in this regard are lead and lead alloys, carbon, platinum plated titanium, and steel. Materials useful for anode means include lead or lead alloys, carbon, and platinum coated titanium. The anode means should also be of a material which is unreactive and insoluble in the electrolyte.

As a specific example of the process of this invention, a 6 inch wide steel strip having a galvanized coating of 0.1 ounce/ft$^2$ on the light side and 0.5 ounces of zinc/ft$^2$ on the heavy side was introduced into an electrolytic solution, essentially in the manner illustrated in FIG. 1. The prototype tank utilized in this case was 52 inches in length, 30 inches wide and 4 feet in depth. It contained about 178 gallons to overflow of an electrolytic solution which was circulated through pipes connecting the treatment tank with a storage tank holding 200 to 300 gallons of the solution. The electrolyte was maintained at a temperature of about 135° F and was separately formulated as 500 gallons of an aqueous solution having a pH of 1.5 and including 1,030 pounds of zinc sulfate along with 75 pounds of concentrated sulfuric acid. The steel strip was passed between the lead anode and a steel cathode, again as depicted in FIG. 1, at a line speed of 10 ft/minute. The total anode area was 1.625 sq. ft., specific dimensions being 39 inches long, 6 inches wide and 0.75 inches thick. The cathode plate's dimensions were 36 × 5 × 0.75 inches. The catholyte, comprising about 3 gallons of a 5 percent by weight aqueous sodium hydroxide solution is contained in a box-shaped structure measuring 37 × 6 × 3 inches, including a foraminous polyvinyl chloride bottom portion to which a perm-selective anion exchange membrane identified as Ionac's MA-3475 membrane is bonded. The bottom portion and membrane were secured to the side portions of the structure in a liquidtight seal. The temperature of the catholyte is maintained at a point about the same as the electrolyte through the use of a water-cooled steel coil which is immersed therein. The total current input in the system is 872 amps, the current density being 540 amps/ft$^2$ and the voltage being 14.5 volts. The electrodes are each spaced about 2 inches from the strip. The treated strip emerging from the tank is found to have one surface, i.e., that previously having the lighter coating, stripped free of zinc while the opposite side of the strip had a zinc coating of about 0.6 ounce/ft$^2$. The zinc surface was still spangled and brighter than the original and the steel cathode remained free of a zinc deposit.

The above embodiments are to be considered in all respects as illustrative and not restrictive since the invention may be embodied in other specific forms without departing from its spirit or essential characteristics. Therefore, the scope of the invention is indicated by the claims rather than by the foregoing description, and all changes which come within the meaning and range of the equivalents of the claims are intended to be embraced therein.

What is claimed is:

1. A method for treating zinc-coated metal strip material comprising:

a. immersing the strip in an electrolyte solution, b. passing the strip through the electrolyte solution and between anode means and cathode means, c. electrolytically removing a zinc coating from the side of the strip facing the cathode means while simultaneously depositing a substantially equivalent amount of zinc on the opposite side of the strip, and d. preventing the formation of a zinc deposit on the cathode means.

2. A method as defined in claim 1 wherein the strip passing between the anode means and the cathode means is a bipolar electrode.

3. A method as defined in claim 2 wherein the formation of a zinc deposit on the cathode means is prevented by immersing the cathode means in a separate caustic catholyte solution which is contained within means including an anion exchange membrane, the container means being supported at least partly within the electrolyte solution so that said membrane is in a spaced relationship with the strip and the anode means, said membrane preventing the migration of zinc ions to said cathode means.

4. A method as recited in claim 3 wherein the anion exchange membrane comprises a strong, base-type anion exchange resin.

5. A method as recited in claim 4 in which the electrolyte solution is an aqueous solution of zinc sulfate and sulfuric acid and contains from about 10 to 20 ounces of zinc metal per gallon of solution.

6. A method as recited in claim 5 wherein the electrolyte solution has a ph of from about 1 to 4.

7. A method as recited in claim 6 wherein the caustic catholyte solution is an aqueous alkali metal hydroxide solution.

8. A method as recited in claim 7 wherein the caustic catholyte solution is a 5 percent by weight aqueous sodium hydroxide solution.

9. A method as recited in claim 7 in which the electrolyte and catholyte solutions are maintained at a temperature within the range of from about 120° to 150° F.

10. A method as recited in claim 9, in which air is introduced into the electrolyte solution so as to provide agitation and minimize formation of a precipitate on the anion exchange membrane.

11. A method as recited in claim 3 in which the spacing between the strip and the anode means is about 0.5 – 3 inches, and the spacing between the strip and the cathode means is about 1 – 4 inches.

12. A method as recited in claim 3 wherein the anode means and cathode means are arranged in a substantially diagonal configuration and the strip is passed between the anode means and cathode means also along a substantially diagonal line.

13. A method as recited in claim 12 in which the anode means and cathode means comprise two sets of electrodes.

14. A method as recited in claim 3 in which subsequent to the electrolytic removal of the zinc coating from the first side of said strip said first side is subjected to a brushing treatment which does not scar the surface of the strip, so as to remove therefrom any residual loose coating.

15. A method as recited in claim 3, in which prior to electrolytic treatment, the zinc coated strip is subjected to an etching treatment so as to improve the adherence thereto of a zinc deposit subsequently applied by said electrolytic treatment.

16. A method of producing galvanized steel strip material having a zinc coating on one side only comprising, a. immersing a zinc-coated steel strip in an aqueous electrolyte solution, said strip having a zinc coating on a first side which is less than a zinc coating on the opposite side, b. passing the zinc-coated strip between anode means and cathode means such that the first side of the strip faces the cathode means, c. electrolytically removing the zinc coating from the first side and simultaneously depositing on the opposite side an amount of zinc equal to that removed from the first side, and d. preventing the formation of a zinc deposit on the cathode means.

17. A method as defined in claim 16 wherein the strip passing between the anode means and the cathode means is a bipolar electrode.

18. The method as defined in claim 17 wherein nthe formation of a zinc deposit on the cathode means is prevented by immersing the cathode means in a separate caustic catholyte solution which is contained within means including an anion exchange membrane, the container means being supported at least partly within the electrolyte solution so that said membrane is in a spaced relationship with the strip and the anode means, said membrane preventing the migration of zinc ions to said cathod means.

19. A method as recited in claim 18 wherein the anion exchange membrane comprises a strong, base-type anion exchange resin.

20. A method as recited in claim 18 in which the zinc coating on the first side of the strip is about 0.01 – 0.15 ounce/ft$^2$ and the zinc coating on the opposite side of the strip is within the range of about 0.2 – 0.7 ounce/ft$^2$.

21. A method as recited in claim 20 in which the electrolyte solution is an aqueous solution of zinc sulfate and sulfuric acid and contains from about 10 to 20 ounces of zinc metal per gallon of solution.

22. A method as recited in claim 21 wherein the electrolyte solution has a pH of from about 1 to 4.

23. A method as recited in claim 22 wherein the caustic catholyte solution is an aqueous alkali metal hydroxide solution.

24. A method as recited in claim 23 wherein the caustic catholyte solution is a 5 percent by weight aqueous sodium hydroxide solution.

25. A method as recited in claim 23 in which the electrolyte and catholyte solutions are maintained at a temperature within the range of from about 120° to 150° F.

26. A method as recited in claim 25 in which air is introduced into the electrolyte solution so as to provide agitation and minimize formation of a precipitate on the anion exchange membrane.

27. A method as recited in claim 18 wherein the apparent current density (calculated average current density) on the strip opposite the cathode means ranges from about 200 to about 1,000 amps/ft$^2$.

28. A method as recited in claim 27 in which the spacing between the strip and the anode means is about 0.5 – 3 inches, and the spacing between the strip and the cathode means is about 1 – 4 inches.

29. A method as recited in claim 18 wherein the anode means and cathode means are arranged in a substantially diagonal configuration and the strip is passed between the anode means and cathode means also along a substantially diagonal line.

30. A method as recited in claim 29, in which the anode means and cathode means comprise two sets of electrodes.

31. A method as recited in claim 18 in which subsequent to the electrolytic removal of the zinc coating from the first side of said strip said first side is subjected to a brushing treatment which does not scar the surface of the strip so as to remove therefrom any residual loose coating.

32. A method as recited in claim 18 in which prior to electrolytic treatment, the zinc coated strip is subjected to an etching treatment so as to improve the adherence thereto of a zinc deposit subsequently applied by said electrolytic treatment.

* * * * *

UNITED STATES PATENT OFFICE

CERTIFICATE OF CORRECTION

Patent No. 3,988,216 Dated October 26, 1976

Inventor(s) L. W. Austin, E. J. Smith, L. D. McGraw

It is certified that error appears in the above-identified patent and that said Letters Patent are hereby corrected as shown below:

Column 3, line 4, "formainous" should read -- foraminous --;

line 39, "manufacturing" should read -- Manufacturing --;

Column 4, line 30, "sulfate" (second occurrence) should read -- sulfuric --;

Column 7, line 58, "ph" should be -- pH --;

Column 8, line 48, "nthe" should read -- the --;

line 57, "cathod" should read -- cathode --.

Signed and Sealed this

Tenth Day of May 1977

[SEAL]

*Attest:*

RUTH C. MASON
*Attesting Officer*

C. MARSHALL DANN
*Commissioner of Patents and Trademarks*